US008630559B2

(12) United States Patent
Hasebe

(10) Patent No.: US 8,630,559 B2
(45) Date of Patent: Jan. 14, 2014

(54) IMAGE FORMING APPARATUS INCLUDING TONER RECEIVER

(75) Inventor: Yoshifumi Hasebe, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 307 days.

(21) Appl. No.: 13/231,815

(22) Filed: Sep. 13, 2011

(65) Prior Publication Data

US 2012/0099885 A1 Apr. 26, 2012

Related U.S. Application Data

(60) Provisional application No. 61/406,994, filed on Oct. 26, 2010.

(51) Int. Cl.
*G03G 21/00* (2006.01)
*G03G 15/08* (2006.01)

(52) U.S. Cl.
USPC ..... 399/98; 399/258

(58) Field of Classification Search
USPC ..... 399/98, 99, 258, 262
See application file for complete search history.

(56) References Cited

U.S. PATENT DOCUMENTS

| | | | | |
|---|---|---|---|---|
| 4,660,958 | A * | 4/1987 | Egami et al. | 399/273 |
| 5,737,675 | A * | 4/1998 | Okada et al. | 399/258 |
| 6,125,250 | A * | 9/2000 | Kamio et al. | 399/98 |
| 6,363,235 | B1 * | 3/2002 | Chiesa et al. | 399/258 |

FOREIGN PATENT DOCUMENTS

| | | |
|---|---|---|
| JP | 2006-018031 | 1/2006 |
| JP | 2008-039930 | 2/2008 |

* cited by examiner

*Primary Examiner* — Sandra Brase
(74) *Attorney, Agent, or Firm* — Patteson & Sheridan L.L.P.

(57) ABSTRACT

According to one embodiment, a toner receiver includes a tray that is located below a path through which a supply port of a supply container passes if the supply container mounted to a main body is removed from the main body, and includes a first surface close to the supply port and a toner sump recessed from the first surface; and a toner guard that includes an upper surface including a same height as the first surface and causes toner spilled from the supply port to pass from the first surface to the toner sump.

18 Claims, 5 Drawing Sheets

IMAGE FORMING APPARATUS INCLUDING TONER RECEIVER

CROSS-REFERENCE TO RELATED APPLICATION

This application is based upon and claims the benefit of priority from Provisional U.S. Application 61/406,994 filed on Oct. 26, 2010, the entire contents of which are incorporated herein by reference.

FIELD

Embodiments described herein relate generally to an image forming apparatus, such as a copying machine or a printer, in which a toner cartridge to supply toner to a developing device is detached from and attached to an apparatus main body.

BACKGROUND

In a developing device of an image forming apparatus of electrophotographic system, such as a copying machine or a printer, there is an apparatus in which toner is supplied to the developing device by an attachable and detachable toner cartridge. Besides, there is an apparatus including a falling toner receiver to receive the toner spilled when a toner cartridge is attached to and detached from the image forming apparatus.

However, if the falling toner receiver is uncovered, there is a fear that during the attachment and detachment operation of the toner cartridge, an operator touches the toner collected in the falling toner receiver, and a large amount of toner adheres to the operator and contaminates the surroundings.

DETAILED DESCRIPTION

In general, according to one embodiment, a toner receiver includes a tray that is located below a path through which a supply port of a supply container passes if the supply container mounted to a main body is removed from the main body, and includes a first surface close to the supply port and a toner sump recessed from the first surface; and a toner guard that includes an upper surface including a same height as the first surface and causes toner spilled from the supply port to pass from the first surface to the toner sump.

Hereinafter, embodiments will be described.

First Embodiment

Figure 1:
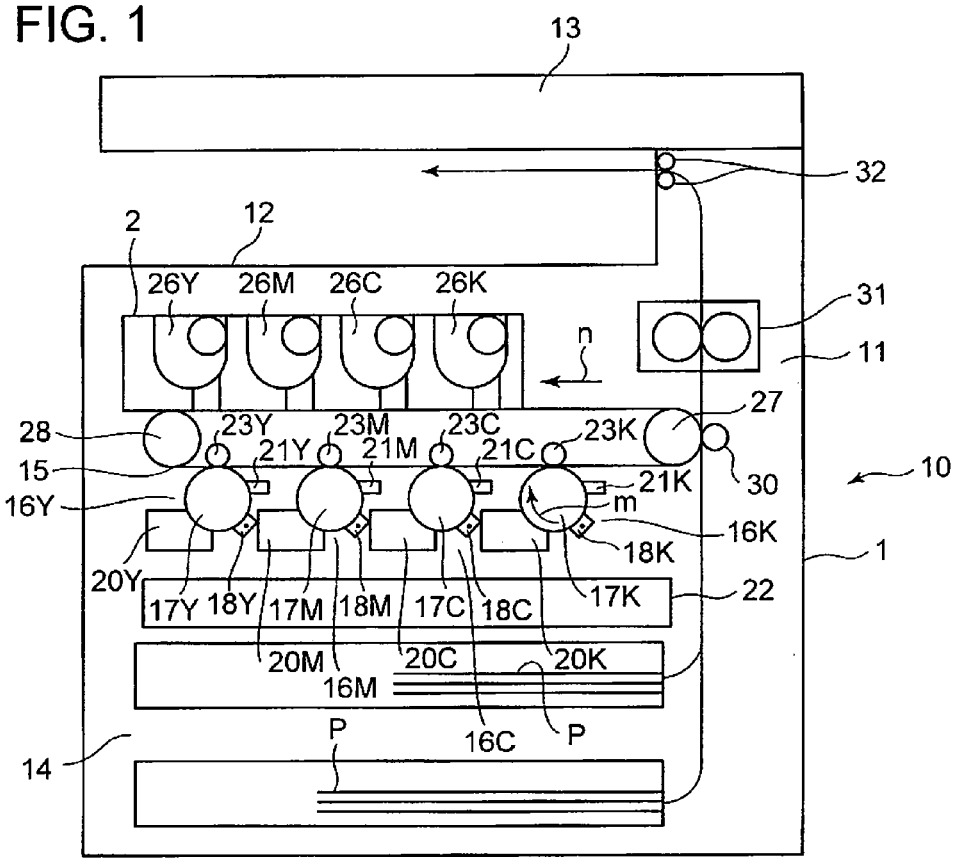
FIG. 1 is a schematic structural view showing an MFP of a first embodiment.

FIG. 1 shows a color MFP (Multi Functional Peripheral) 10 as an image forming apparatus of a first embodiment. The MFP 10 includes, for example, a printer part 11 to form an image, a paper discharge part 12 to receive a sheet P discharged from the printer part 11, a scanner part 13 to read an image, and a paper feed part 14 to feed the sheet P.

The printer part 11 includes four sets of image forming stations 16Y, 16M, 16C and 16K of Y (yellow), M (magenta), C (cyan) and K (black), which are arranged in parallel along the lower side of an intermediate transfer belt 15. The image forming stations 16Y, 16M, 16C and 16K respectively include photoconductive drums 17Y, 17M, 17C and 17K as image carriers.

The respective image forming stations 16Y, 16M, 16C and 16K include chargers 18Y, 18M, 18C and 18K, developing devices 20Y, 20M, 20C and 20K as developing parts, and photoconductive cleaners 21Y, 21M, 21C and 21K around the photoconductive drums 17Y, 17M, 17C and 17K rotating in an arrow m direction.

Primary transfer rollers 23Y, 23M, 23C and 23K are arranged at positions opposite to the photoconductive drums 17Y, 17M, 17C and 17K across the intermediate transfer belt 15. The respective primary transfer rollers 23Y, 23M, 23C and 23K primarily transfer toner images formed on the photoconductive drums 17Y, 17M, 17C and 17K to the intermediate transfer belt 15. The respective photoconductive cleaners 21Y, 21M, 21C and 21K remove and collect remaining toner on the photoconductive drums 17Y, 17M, 17C and 17K after the primary transfer.

A laser exposure device 22 irradiates exposure lights corresponding to the respective colors to the photoconductive drums 17Y, 17M, 17C and 17K between the chargers 18Y, 18M, 18C and 18K and the developing devices 20Y, 20M, 20C and 20K. Electrostatic latent images are formed on the respective photoconductive drums 17Y, 17M, 17C and 17K by the irradiation of the respective exposure lights from the laser exposure device 22.

The respective developing devices 20Y, 20M, 20C and 20K use two-component developer including toner and carrier, and supply the toner to the electrostatic latent images on the photoconductive drums 17Y, 17M, 17C and 17K to visualize the electrostatic latent images. The respective developing devices 20Y, 20M, 20C and 20K uses the two-component developer including the toner of Y (yellow), M (magenta), C (cyan) and K (black) and the carrier, and develops the images.

A housing 1 of the MFP 10 as a main body includes a cartridge box 2 to and from which toner cartridges 26Y, 26M, 26C and 26K as supply containers are attached and detached, which is located above the respective developing devices 20Y, 20M, 20C and 20K. The respective toner cartridges 26Y, 26M, 26C and 26K mounted to the cartridge box 2 respectively contain toners of Y (yellow), M (magenta), C (cyan) and K (black). If the toner densities of the respective developing devices 20Y, 20M, 20C and 20K are decreased, the respective toner cartridges 26Y, 26M, 26C and 26K supply a necessary amount of toner to the respective developing devices 20Y, 20M, 20C and 20K.

The intermediate transfer belt 15 is stretched between a backup roller 27 and a driven roller 28, and rotates in an arrow n direction. A secondary transfer roller 30 is opposite to a secondary transfer position of the intermediate transfer belt 15 supported by the backup roller 27. A specified secondary transfer bias is applied to between the backup roller 27 and the secondary transfer roller 30. Toner images on the intermediate transfer belt 15 are collectively secondarily transferred onto the sheet P passing through between the intermediate transfer belt 15 and the secondary transfer roller 30.

The printer part 11 includes a fixing device 31 and a paper discharge roller 32 at the downstream side of the secondary transfer roller 30 along the conveyance direction of the sheet P. The fixing device 31 fixes the toner image transferred to the sheet P by the secondary transfer part to the sheet P. The paper discharge roller 32 discharges the sheet P having the fixed toner image to the paper discharge part 12.

Figure 2:
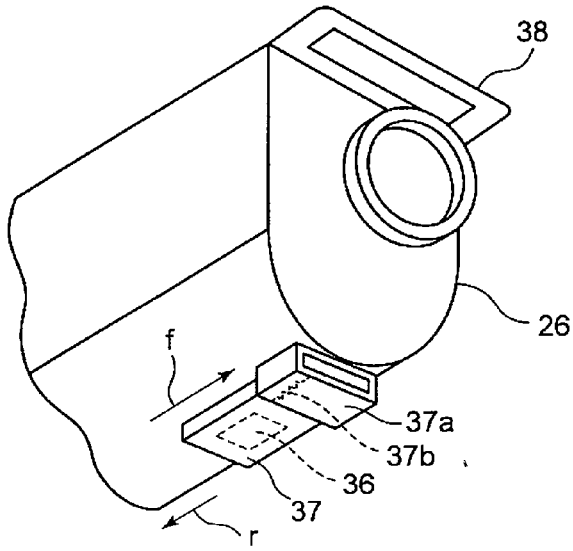
FIG. 2 is a schematic perspective view which a toner cartridge of the first embodiment is seen from below.

The toner cartridges 26Y, 26M, 26C and 26K have the same structure although the contained toners are different. Next, the structures of the toner cartridges 26Y, 26M, 26C and 26K will be described with reference to FIG. 2 while common reference numerals are used. As shown in FIG. 2, a toner cartridge 26 includes a toner supply port 36 at the front side. The toner cartridge 26 includes a shutter 37 to open and close the toner supply port 36. In the operation of mounting the toner cartridge 26 to the cartridge box 2, the shutter 37 opens the toner supply port 36 by contact with an after-mentioned hook 3*b*. In the operation of removing the toner cartridge 26 from the cartridge box 2, the shutter 37 closes the toner supply port 36 by a spring 37*b* provided in a shutter support part 37*a*. The toner cartridge 26 includes a handle 38 for attaching and detaching the toner receiver 26 to and from the cartridge box 2.

Figure 3:
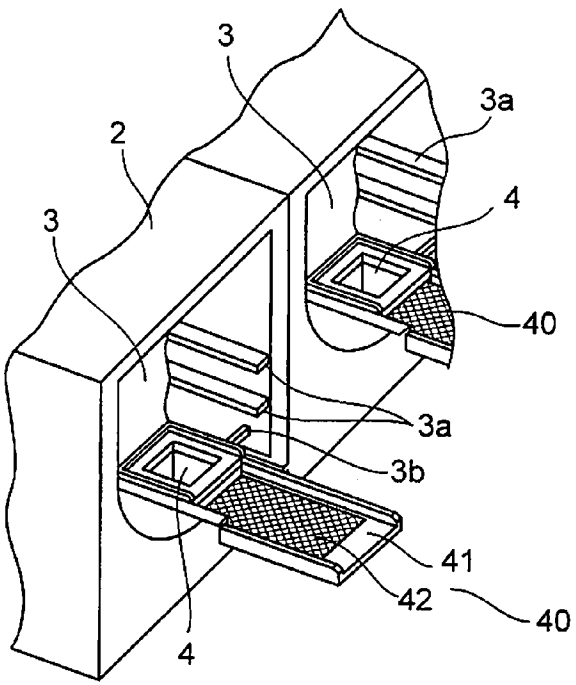
FIG. 3 is a partial schematic perspective view showing a cartridge box and a toner receiver of the first embodiment.

As shown in FIG. 3, the cartridge box 2 includes a toner inflow port 4 in the bottom of a cartridge containing part 3. A hook 3*b* to slide the shutter 37 of the toner cartridge 26 is provided on the side surface of the cartridge containing part 3. For example, if the user mounts the toner cartridge 26 to the cartridge box 2 along a guide rail 3*a*, the shutter 37 contacts the hook 3*b* and slides in an arrow f direction. The toner supply port 36 of the toner cartridge 26 is opened, and the toner supply port 36 communicates with the toner inflow port 4. The toner in the cartridge box 2 is supplied from the toner supply port 36 through the toner inflow port 4 to the developing devices 20Y, 20M, 20C and 20K.

If the user removes the toner cartridge 26 along the guide rail 3*a* from the cartridge box 2, the shutter 37 slides in an arrow r direction by the spring 37*b* and closes the toner supply port 36. If the toner cartridge 26 is removed from the cartridge box 2, the toner adhered to the periphery of the toner supply port 36 is prevented from spilling.

A toner receiver 40 is arranged at a position adjacent to the toner inflow port 4 at the front side of the cartridge box 2 and below a path through which the toner supply port 36 of the toner cartridge 26 passes if the toner cartridge 26 is attached to and detached from the cartridge box 2. The toner receiver 40 can be attached to and detached from the cartridge box 2. The toner receiver 40 includes a tray 41 and a mesh 42 to cover the tray 41, which is a toner guard.

Figure 4:
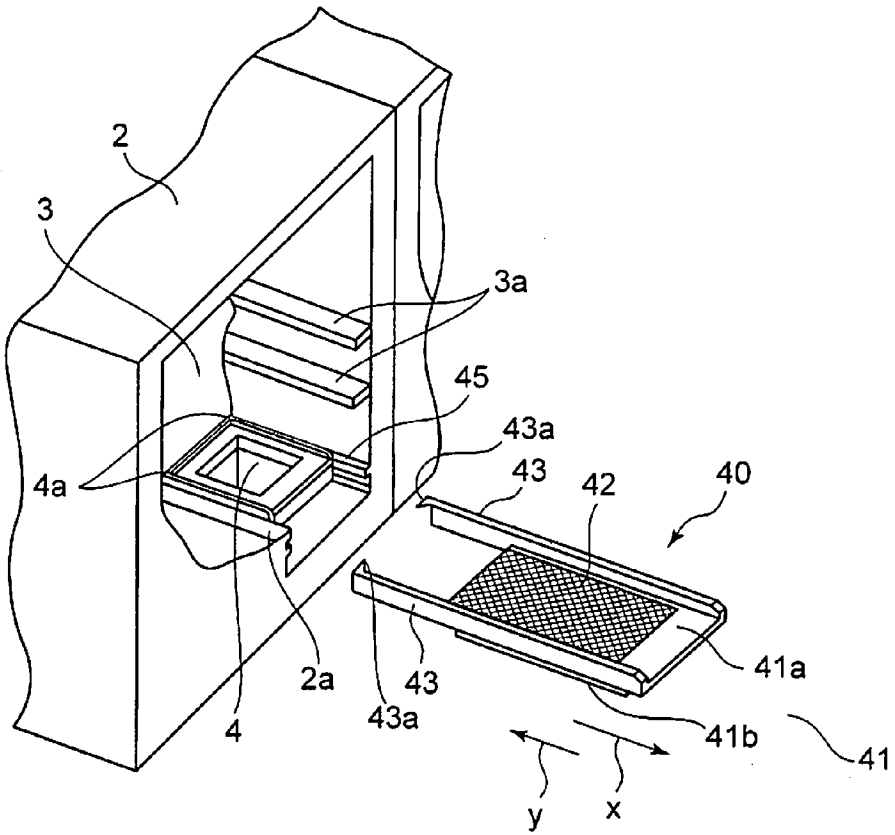
FIG. 4 is a schematic perspective view showing a state where the toner receiver of the first embodiment is disconnected from the cartridge box.

As shown in FIG. 4, the toner receiver 40 includes a stay 43 for fixing to the cartridge box 2. The toner receiver 40 is guided by a tray guide 45 formed in the cartridge box 2, and is mounted to the cartridge box 2. A fastening part 43*a* of a leading edge of the stay 43 is fastened to a fixing part 4*a* formed at the rear side of the toner inflow port 4, and the toner receiver 40 is fixed to the cartridge box 2.

If a toner sump has a capacity capable of collecting the toner spilled from the toner cartridge 26, the toner receiver may be fixed to the cartridge box. Further, the position of the toner supply port 36 of the toner cartridge 26 is not limited to the front side.

Figure 5:
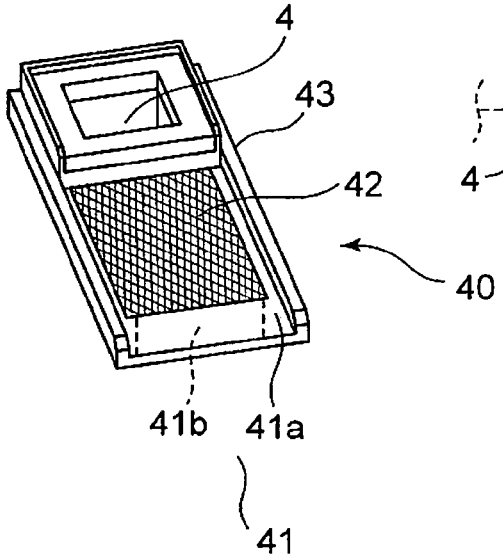
FIG. 5 is a schematic perspective view showing the toner receiver and a toner inflow port of the first embodiment.
Figure 6:
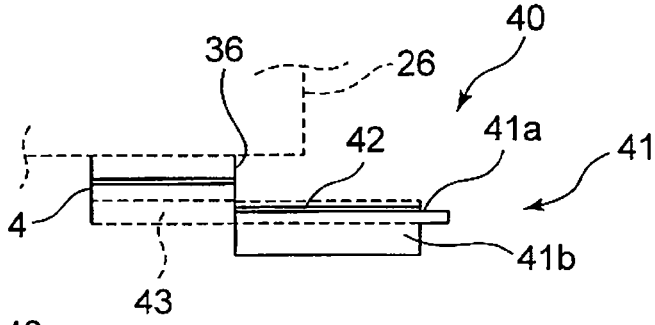
FIG. 6 is a schematic side view showing the toner receiver and the toner inflow port of the first embodiment.

As shown in FIGS. 4 to 6, the tray 41 of the toner receiver 40 includes a tray surface 41*a* as a first surface close to the toner supply port 36 of the toner cartridge 26 mounted to the cartridge box 2 and a toner sump 41*b* formed to be recessed from the tray surface 41*a*. The mesh 42 covers the tray surface 41*a*. The roughness of the mesh 42 is such that even if a finger of a user who performs the attachment and detachment operation of the toner cartridge 26 touches the tray 41, the finger can be prevented from touching the toner sump 41*b*.

The toner spilled from the toner supply port 36 to the toner receiver 40 if the toner cartridge 26 is attached to and detached from the cartridge box 2 does not stay on the tray surface 41*a* but passes through the mesh 42 and is collected in the toner sump 41*b*.

Figure 7:
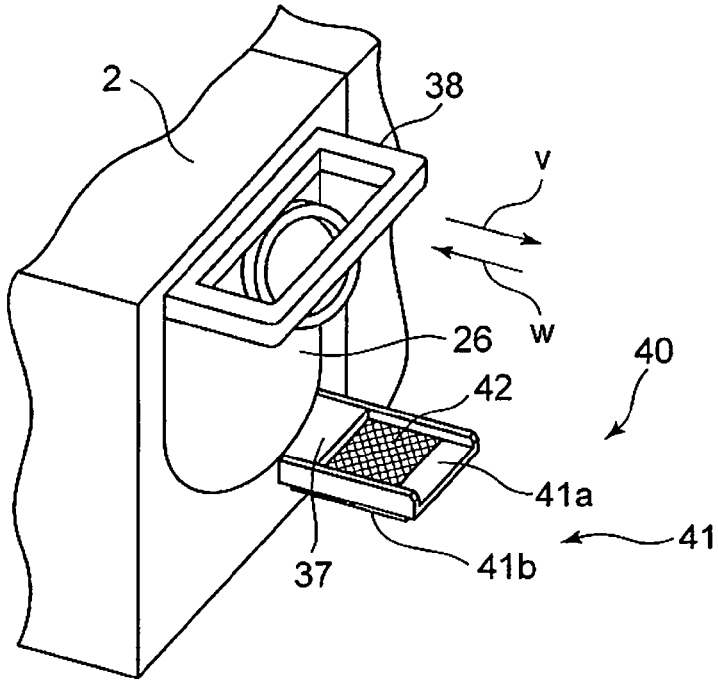
FIG. 7 is a schematic perspective view showing a state where the toner cartridge of the first embodiment is mounted to the cartridge box.

If toner is supplied to the developing devices 20Y, 20M, 20C and 20K during printing and the toner cartridge 26 becomes empty, for example, the user replaces the toner cartridge 26. As shown in FIG. 7, the user pulls the empty cartridge 26 in an arrow v direction, and removes the toner cartridge 26 from the cartridge box 2. In the operation of removing the toner cartridge 26 from the cartridge box 2, the shutter 37 slides in the arrow r direction by the spring 37*b* and closes the toner supply port 36.

If the toner cartridge 26 is removed, the toner can spill from the periphery of the toner supply port 36. However, even if the toner spills from the periphery of the toner supply port 36, the spilled toner is received by the toner receiver 40 below the path through which the toner supply port 36 passes. Further, the toner received by the toner receiver 40 passes through the mesh 42 covering the tray surface 41*a* and is collected in the toner sump 41*b*. The toner spilled from the periphery of the toner supply port 36 is not deposited on the tray surface 41*a*.

Next, the user slides a new toner cartridge 26 along the guide rail 3*a* of the cartridge containing part 3 in an arrow w direction of FIG. 7, mounts the toner cartridge to the cartridge box 2, and completes the replacement operation of the toner cartridge 26. Even if the user touches the tray 41 during the replacement operation of the toner cartridge 26, since the mesh 42 guards the upper part of the toner sump 41*b*, the user merely touches the surface of the mesh 42 on which toner is not deposited, and does not touch the toner sump 41*b* in which toner is deposited. The mesh 42 can suppress the amount of toner adhered to the user.

For example, if a large amount of toner erroneously spills to the toner receiver 40 and the toner sump 41*b* becomes full, the user removes the toner receiver 41 from the cartridge box 2, and the user sweeps away the toner collected in the toner sump 41*b*. The user disconnects the fastening part 43*a* of the leading edge of the stay 43 from the fixing part 4*a*, and pulls out the toner receiver 40 in an arrow x direction of FIG. 4. The user sweeps away the toner collected in the toner sump 41*b* of the toner receiver 40 pulled out from the cartridge box 2. The user sweeps away the collected toner, slides the cleaned toner receiver 40 in an arrow y direction along the tray guide 45, and fixes the toner receiver to the cartridge box 2.

According to the first embodiment, in the color MFP 10, the tray surface 41*a* of the toner receiver 40 is covered with the mesh 42, and the user is prevented from touching the toner collected in the toner sump 41*b*. During the replacement operation of the toner cartridge 26, the user does not touch the toner sump 41*b* in which toner is collected, and the amount of toner adhered to the user can be suppressed. If the toner sump

41*b* becomes full, the user removes the toner receiver 41 from the cartridge box 2, and the user sweeps away the collected toner. The toner collected in the toner sump 41*b* can be easily removed if necessary.

Second Embodiment

Next, a second embodiment will be described. In the second embodiment, a toner receiver is provided in a cartridge box of, for example, a monochrome MFP. In the second embodiment, the same component as the component described in the first embodiment is denoted by the same reference numeral, and its detailed description is omitted. In the toner receiver of the second embodiment, a toner guard is arranged in a toner sump.

Figure 8:
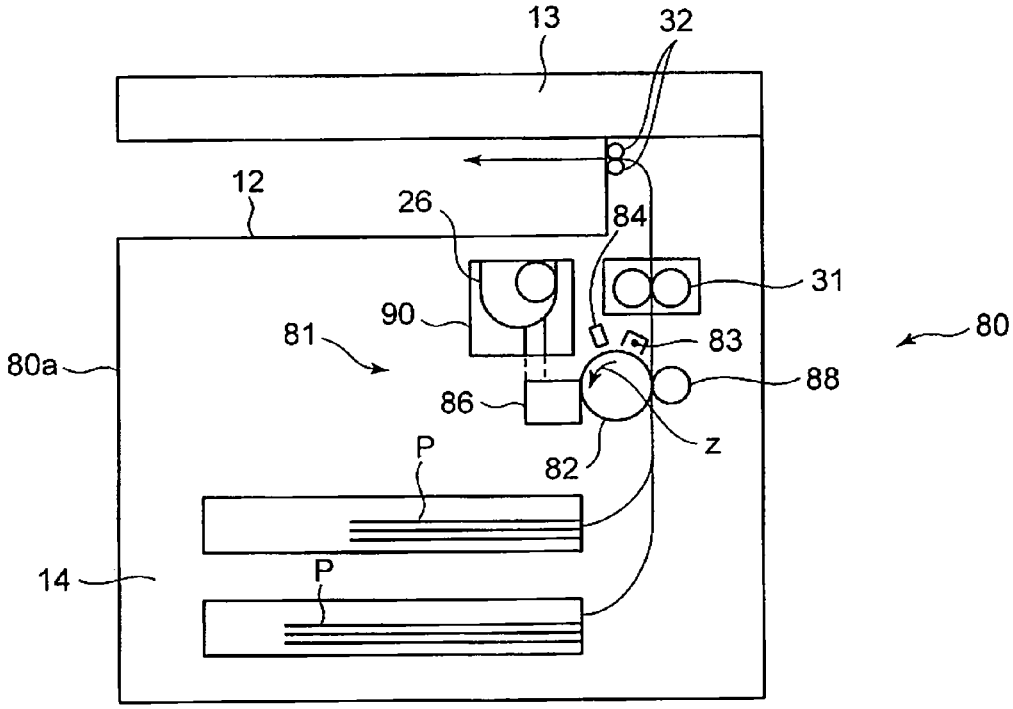
FIG. 8 is a schematic structural view showing an MFP of a second embodiment.

A printer part 81 of a monochrome MFP 80 shown in FIG. 8, which is an image forming apparatus of the second embodiment, includes a charger 83, an exposure device 84, a developing device 86 and a transfer device 88 around a single photoconductive drum 82 rotating in an arrow z direction. The charger 83 uniformly charges the photoconductive drum 82, and the exposure device 84 irradiates exposure light and forms an electrostatic latent image on the photoconductive drum 82. The developing device 86 uses two-component developer including, for example, K (black) toner and carrier, and supplies the toner to the electrostatic latent image on the photoconductive drum 82 to visualize the electrostatic latent image. The transfer device 88 transfers a toner image formed on the photoconductive drum 82 onto a sheet P.

A housing 80*a* of the MFP 80 as a main body includes a cartridge box 90 to and from which a toner cartridge 26 is attached and detached in the upper part of the developing device 86. The toner cartridge 26 containing k (black) toner is mounted to the cartridge box 90, and supplies the K (black) toner to the developing device 86.

Figure 9:
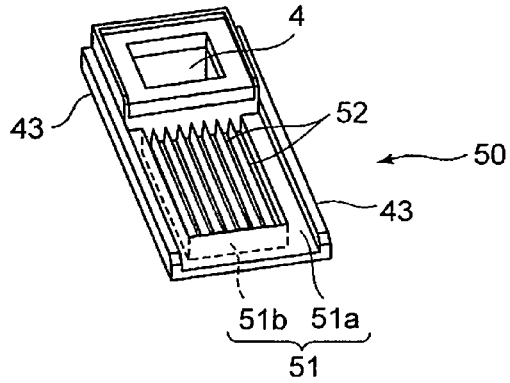
FIG. 9 is a schematic perspective view showing a toner inflow port and a toner receiver of the second embodiment.

A toner receiver 50 shown in FIG. 9 is arranged at a position adjacent to a toner inflow port 4 and below a path through which a toner supply port 36 of the toner cartridge 26 passes. In the toner receiver 50, many thin plate-like guards 52 as toner guards are formed in parallel in a toner sump 51*b* which is formed to be recessed from a tray surface 51*a*. The upper end of the guard 52 has the same height as the tray surface 51*a*. An interval between the plural guards 52 is such that a finger of a user who performs the attachment and detachment operation of the toner cartridge 26 can be prevented from touching the toner sump 51*b*. A tray 51 and the guards 52 are integrally formed of, for example, synthetic resin.

The toner spilled from the periphery of the toner supply port 36 of the toner cartridge 26 to the toner receiver 50 does not stay on the tray surface 51*a*, but passes through the gaps of the plural guards 52 to the toner sump 51*b*. Even if the user touches the upper end of the guard 52, on which toner is not deposited, during the replacement operation of the toner cartridge 26, the user is prevented by the guard 52 and does not touch the toner sump 51*b* in which the toner is deposited.

Figure 10:
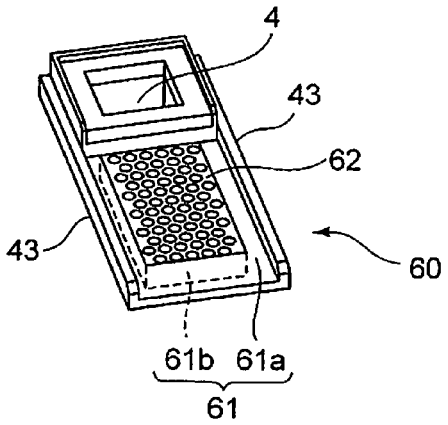
FIG. 10 is a schematic perspective view showing a toner inflow port and a toner receiver of a first other example.

Incidentally, the toner guards arranged in the toner sump 51*b* are not limited to thin plate-like ones. For example, as in a first other example shown in FIG. 10, a guard 62 is formed in a tray 61 of a toner receiver 60 provided adjacently to a toner inflow port 4 while leaving many hole-like toner sumps 61*b*. The upper end of the guard 62 has the same height as a tray surface 61*a*. The guard 62 prevents a finger of a user who performs the attachment and detachment operation of the toner cartridge 26 from entering the hole-like toner sumps 61*b*. The tray 61 and the guard 62 are integrally formed of, for example, synthetic resin.

Figure 11:
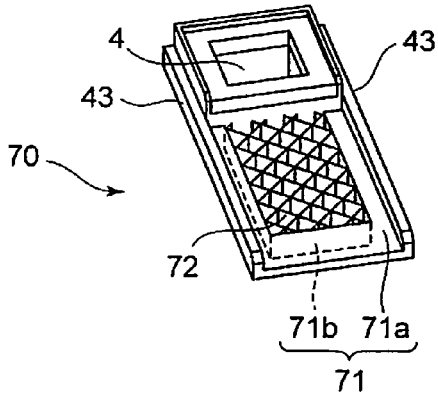
FIG. 11 is a schematic perspective view showing a toner inflow port and a toner receiver of a second other example.

Further, as in a second other example shown in FIG. 11, the toner guard arranged in the toner sump is made a lattice guard 72. The upper end of the guard 72 is made to have the same height as a tray surface 71*a*. The roughness of the lattice of the guard 72 is such an interval that a finer of a user who performs the attachment and detachment operation of the toner cartridge 26 can be prevented from touching a toner sump 71*b*. For example, the guard 72 is formed separately from a tray 71, and the guard 72 is fitted in the toner sump 71*b* to form the toner receiver 70.

According to the second embodiment, in the monochrome MFP 80, the guard 52 is formed in the toner sump 51*b* of the toner receiver 50. Similarly to the first embodiment, during the replacement operation of the toner cartridge 26, the guard 52 prevents the user from touching the toner sump 51*b*, and the amount of toner adhered to the user is suppressed.

According to at least one of the embodiments, the worker does not touch the collected toner during the replacement operation of the supply container, and the toner adhered to the worker is decreased.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A toner receiver comprising:

a tray that is located below a path through which a supply port of a supply container passes if the supply container mounted to a main body is removed from the main body, and includes a first surface close to the supply port and a toner sump recessed from the first surface; and a toner guard that includes an upper surface including a same height as the first surface and causes toner spilled from the supply port to pass from the first surface to the toner sump.

2. The toner receiver of claim 1, wherein the toner guard includes a roughness to prevent an operator of the supply container from touching the toner sump.

3. The toner receiver of claim 1, wherein the toner guard is a mesh arranged on the first surface.

4. The toner receiver of claim 1, wherein the toner guard is a partition extending from the first surface to the toner sump.

5. The toner receiver of claim 1, wherein the tray and the toner guard are integrally formed.

6. The toner receiver of claim 1, wherein the tray can be attached to and detached from the main body.

7. An image forming apparatus comprising:

a developing device to develop an electrostatic latent image formed on an image carrier;

a supply container to supply toner to the developing device;

a tray that is located below a path through which a supply port of the supply container passes if the supply container mounted to a main body is removed from the main body, and includes a first surface close to the supply port and a toner sump recessed from the first surface; and a toner guard that includes an upper surface including a same height as the first surface and causes toner spilled from the supply port to pass from the first surface to the toner sump.

8. The apparatus of claim 7, wherein the toner guard includes a roughness to prevent an operator of the supply container from touching the toner sump.

9. The apparatus of claim 7, wherein the toner guard is a mesh arranged on the first surface.

10. The apparatus of claim 7, wherein the toner guard is a partition extending from the first surface to the toner sump.

11. The apparatus of claim 7, wherein the apparatus is a color image forming apparatus comprising a plurality of the developing devices, and the tray is arranged below each of a plurality of paths through which supply ports of a plurality of the supply containers to supply the toner to the plurality of the developing devices pass.

12. The apparatus of claim 7, wherein the apparatus is a monochrome image forming apparatus comprising the one developing device.

13. The apparatus of claim 7, wherein the tray and the toner guard are integrally formed.

14. The apparatus of claim 7, wherein the tray can be attached to and detached from the main body.

15. A toner receiving method comprising:

removing a supply container mounted to a main body from the main body;

receiving toner falling from a supply port by a first surface close to the supply port at a place below a path through which the supply port of the supply container passes; and collecting the toner received by the first surface to a toner sump that is recessed from the first surface, is far from the supply port as compared with the first surface and has no possibility that an operator of the supply container touches.

16. The method of claim 15, wherein the toner sump is prevented by a toner guard from being touched by the operator.

17. The method of claim 16, wherein the toner guard is a mesh covering a surface of the toner sump.

18. The method of claim 16, wherein the toner guard is a partition formed in the toner sump.

* * * * *